US008814383B2

(12) United States Patent
Bizzotto et al.

(10) Patent No.: US 8,814,383 B2
(45) Date of Patent: Aug. 26, 2014

(54) LIGHTING MODULE

(71) Applicant: OSRAM GmbH, Munich (DE)

(72) Inventors: Alessandro Bizzotto, Castelfranco Veneto (IT); Ludwig Nieberle, Kaldorf (DE); Alessandro Scordino, Dolo (IT)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/739,676

(22) Filed: Jan. 11, 2013

(65) Prior Publication Data

US 2013/0176728 A1 Jul. 11, 2013

(30) Foreign Application Priority Data

Jan. 11, 2012 (IT) ..... TO2012A0015

(51) Int. Cl.

| | |
|---|---|
| ***F21V 21/08*** | (2006.01) |
| ***F21S 4/00*** | (2006.01) |
| ***F21S 8/00*** | (2006.01) |
| ***F21V 29/00*** | (2006.01) |

(52) U.S. Cl.
USPC ..... 362/237; 362/249.02; 362/294; 362/648

(58) Field of Classification Search
USPC ..... 362/237, 240, 244, 249.01, 249.02, 362/391, 648, 294, 373, 218, 646; 439/110, 439/111
See application file for complete search history.

(56) References Cited

U.S. PATENT DOCUMENTS

| | | | | |
|---|---|---|---|---|
| 6,502,968 | B1 * | 1/2003 | Simon | 362/489 |
| 6,659,623 | B2 * | 12/2003 | Friend | 362/249.06 |
| 2009/0284988 | A1 | 11/2009 | Snagel et al. | |

FOREIGN PATENT DOCUMENTS

| | | |
|---|---|---|
| DE | 20 2006 015 827 | 12/2006 |
| WO | WO 2011/139764 | 11/2011 |

* cited by examiner

*Primary Examiner* — Thomas Sember
(74) *Attorney, Agent, or Firm* — Cozen O'Connor

(57) ABSTRACT

A lighting module (10), for example of the LED type, for mounting on a rail comprises a circuit board (12) for carrying one or more light radiation sources (L), and a support structure (14) with a first side (14A) facing the rail and carrying the aforementioned circuit board (12) and a second side (14*b*) situated on the opposite side to the rail and carrying one or more lenses (16) for the light radiation sources (L). The support structure (14) carries one or more flexible electrical contacts (18) having a first end (18*a*) protruding from the first side (14*a*) of the support structure (14) for making contact with an electrical line (T) provided on the rail (R) and a second end (18*b*) which extends towards the circuit board (12) so as to provide electrical contact for the light radiation source or sources (L).

12 Claims, 4 Drawing Sheets

LIGHTING MODULE

RELATED APPLICATIONS

This application claims the priority of Italian application no. TO2012A000015 filed Jan. 11, 2012, the entire content of which is hereby incorporated by reference.

FIELD OF THE INVENTION

The present description relates to lighting modules.

Various embodiments may relate to lighting modules which can be mounted on a rail.

BACKGROUND OF THE INVENTION

For the manufacture of lighting modules, for example of the type intended to be mounted on a rail, it is possible to use electrical connection devices (for example plug-type connectors, wires, etc.) arranged on a circuit board (for example a printed circuit board or PCB).

The overall design may be based on the need to take into account the power to be dissipated, with the result that, in order to meet this requirement, dedicated lighting modules which may be partially or completely incompatible with each other may be produced.

There therefore exists the need for solutions which are able to provide an intrinsically simple electrical/mechanical/thermal connection between a light radiation source and an optical device. It is also desirable that the assembly and the components should be easy to handle, install and remove in the event of replacement and may if necessary be customized depending on different power requirements. There may also exist the need for lighting modules which can be reconfigured in a simple manner so as to be able to receive light radiation sources of varying power levels, where connection together with a heat sink may or may not be required.

SUMMARY OF THE INVENTION

One object of the invention is to provide a solution to the abovementioned requirements.

This and other objects are attained in accordance with one aspect of the present invention directed to a lighting module for mounting on a rail having at least one electrical line extending therealong. The module comprises a circuit board for carrying at least one light radiation source, and a support structure with a first side facing the rail and carrying said circuit board and a second side situated on the opposite side to the rail and carrying at least one lens for the at least one light radiation source. The support structure carries at least one flexible electrical contact having a first end protruding from the first side of the support structure for making contact with the at least one electrical line and a second end which extends toward the circuit board so as to provide electrical contact for the at least one light radiation source.

Various embodiments may envisage the production of a module comprising a support element (for example for carrying one or more lenses) having integrated, spring-action, electrical connectors and a resilient system for retaining the circuit board, with the possibility of also providing a secondary snap-engagement system for connecting the module to a rail.

Various embodiments may envisage the possibility of connecting the module to an auxiliary heat sink only when the installed power is such as to exceed the intrinsic dissipation capacity of the module.

With various embodiments it is possible to obtain a mounting structure which is stable and at the same time articulated, with the possibility of providing light radiation sources with integrated optical and electronic functions without having to use special connection devices which may require additional operations such as screwing operations.

With various embodiments it is possible to achieve one or more of the following advantages:

an intrinsically compact and stable mounting structure which incorporates optical, electronic and thermal functions;

manufacturing process which is simple and reliable from a qualitative point of view;

simple and rapid mounting procedure;

intrinsically simple replacement and handling of the lighting module and its accessories, without the need for additional fixing device elements;

availability of a multifunctional fixing structure.

BRIEF DESCRIPTION OF THE DRAWINGS

The invention will now be described, purely by way of a non-limiting example, with reference to the accompanying figures in which.

DETAILED DESCRIPTION OF THE DRAWINGS

Figure 1:
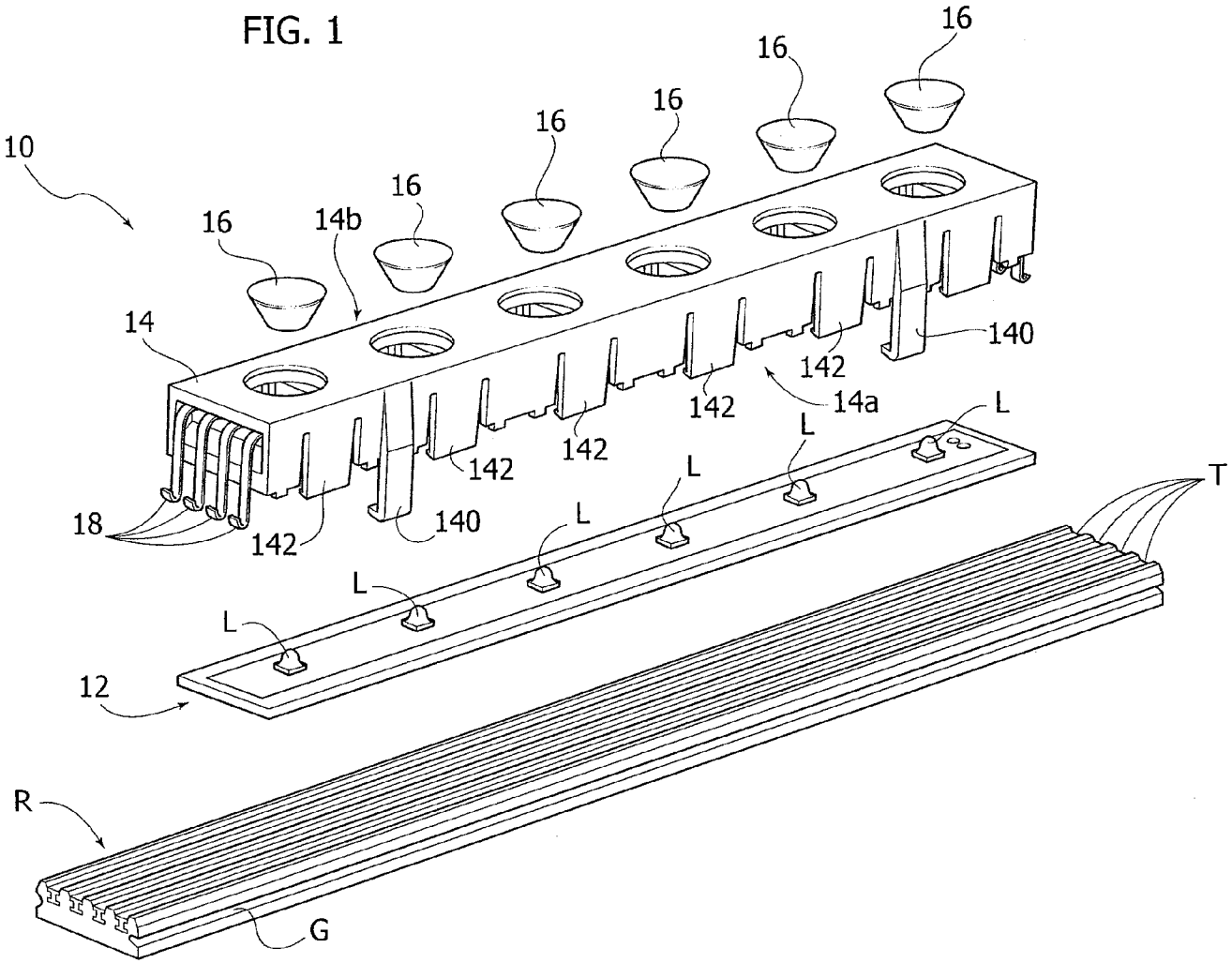
FIG. 1 is a general, exploded, perspective view of an embodiment.

In the following description various specific details aimed at providing a fuller understanding of the embodiments are described. The embodiments may be implemented without one or more of the specific details or using other methods, components, materials, etc. In other cases, known structures, materials or operations are not shown or described in detail so that the various aspects of the embodiments may be understood more clearly.

The reference to "an embodiment" in the context of this description indicates that a particular configuration, structure or characteristic feature described in relation to the embodiment is included in at least one embodiment. Therefore, phrases such as "in an embodiment", which may occur at various points in this description, do not necessarily refer to the same embodiment. Moreover, particular forms, structures or characteristic features may be combined in any suitable manner in one or more embodiments.

The reference numbers used here are provided solely for the sake of convenience and therefore do not define the scope of protection or the range of application of the embodiments.

In the figures, the reference number 10 denotes in its entirety a lighting module intended to be mounted on a rail R (considered here as being an element of indefinite length) comprising one or more electrically conducting lines (or tracks or paths) T which extend in the direction of the length of the rail R.

In various embodiments, the module 10 may comprise a board 12 (for example a printed circuit board or PCB) for carrying one or more light radiation sources L consisting, for example, of LED radiation sources.

In various embodiments, the module 10 may also comprise a support structure 14 (for example made of molded plastic or light metal) where the following may be distinguished:

a first side 14*a* intended to face the rail R and carrying the board 12, for example by means of a spring-action gripper connection (as can be seen in the views of FIG. 2, which are substantially comparable to cross-sectional views relative to the direction of extension of the rail R); and a second side 14*b* situated on the opposite side to the rail R and carrying one or more lenses 16 acting as (primary) optical components for focusing the light radiation emitted by the light source or light sources L.

The reference number 18 denotes one or more electrical contacts of the generally flexible type (for example resilient contacts, for example with a flat-spring structure) which can be provided with:

a first end 18*a* (for example with a slider-like shape, such as a curved shape) which is able to make flexible contact with the line or lines T; and a second end 18*b* which may extend towards the board 12 so as to provide an electrical contact for the source or sources L.

The exemplary embodiments considered here (which are so formed) refer to an embodiment where the rail R comprises four conducting lines T so that the support structure 14 has four contacts 18.

With a solution of this type it is possible, for example, to use one of the lines T (and therefore one of the contacts 18) to form an electrical ground connection and use the other three lines T and other three contacts 18 to provide three separate power supply lines, with the consequent possibility—for example—of forming a lighting module comprising three light sources (or three light source units) with different color characteristics, for example such as to form a three-color system (e.g. RGB) with the consequent possibility of generating, for example, light radiation, the color temperature of which or, more generally, the color of which may be modified and varied.

The tracks T (and therefore contacts 18) may moreover be present in any number, for example so as to provide a system in which two lines (for example, one ground and the other "live") provide the power supply for several "intelligent" light sources mounted on the board 12, while the other line T (and another contact 18) allow control/feedback information regarding the operation of the radiation sources themselves to be exchanged with the "intelligence" (e.g. one or more microcontrollers) associated with the light sources L. All this may be performed in a manner which is known per se and therefore does not require detailed description here.

Figure 2C:
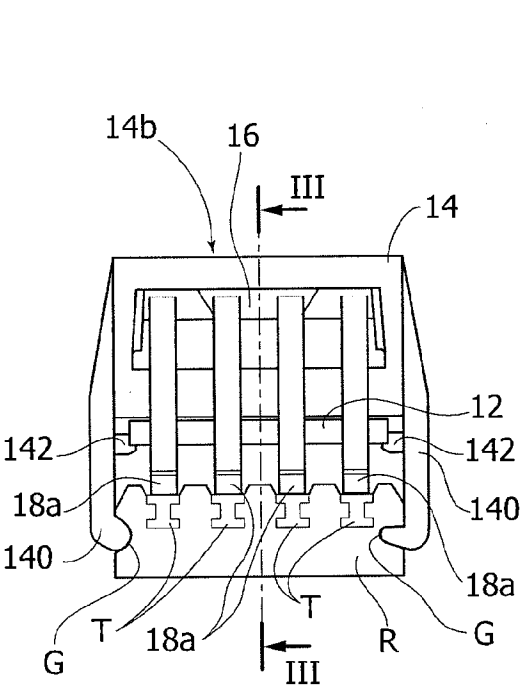
FIGS. 2A, 2B and 2C show schematically a possible sequence for mounting an embodiment on a rail.
Figure 2B:
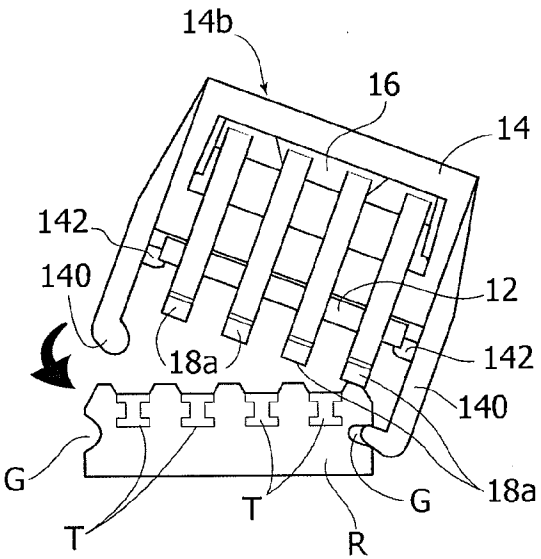
Figure 2A:
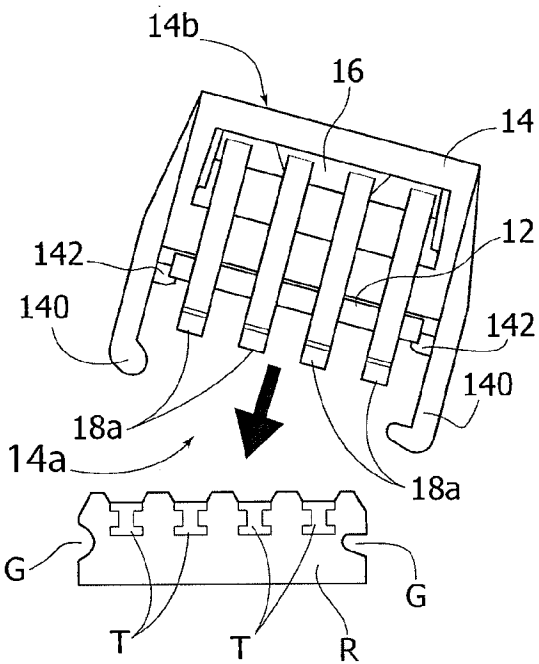

In various embodiments, as can be seen more clearly in the views of FIGS. 2A-2C, the support structure 14 may have lateral arms able to perform at least one of two functions:

retaining the board 12 carrying the light sources L by means of a resilient connection (basically a resilient gripper clamping system) on the support structure 14; and providing a form-fit connection (for example of the snap-engagement type) with the rail R.

In the exemplary embodiment considered here two types of arms are provided, i.e. longer arms (arms 140) and shorter arms (arms 142), which are for example ordered in pairs of oppositely arranged arms situated on the opposite sides of the structure 14.

The remote sections of the arms 140, which are longer and therefore project beyond the board 12, have terminal ends directed towards the inside of the structure 14 with the consequent possibility of engaging with the grooves G provided on the sides of the rail R.

The remote sections of the arms 142, which are shorter, have terminal ends which are approximately coplanar with the board 12 and which act on the sides of the board 12, retaining it on the structure 14. The retaining action thus exerted may be rendered even more stable by providing these arms with hook-shaped or fork-shaped remote ends which are therfore able to clasp the edge of the board 12.

In various embodiments, the support structure 14 may therefore have a general channel-shaped form with a bottom or central wall, which is located on the side 14*b* opposite to that of the rail R and carries the lenses 16, and side walls comprising the arms 140 and 142.

The fact that the remote terminal portions of the arms 140 extend beyond the plane in which the board 12 lies ensures that (as can be seen more clearly in FIG. 3) between the board 2 and the rail R there is, on the side 14*a* of the structure 14 facing the rail R, a ventilation space W which facilitates dissipation of the heat from the board 12 on which the light sources L are mounted.

Figure 3:
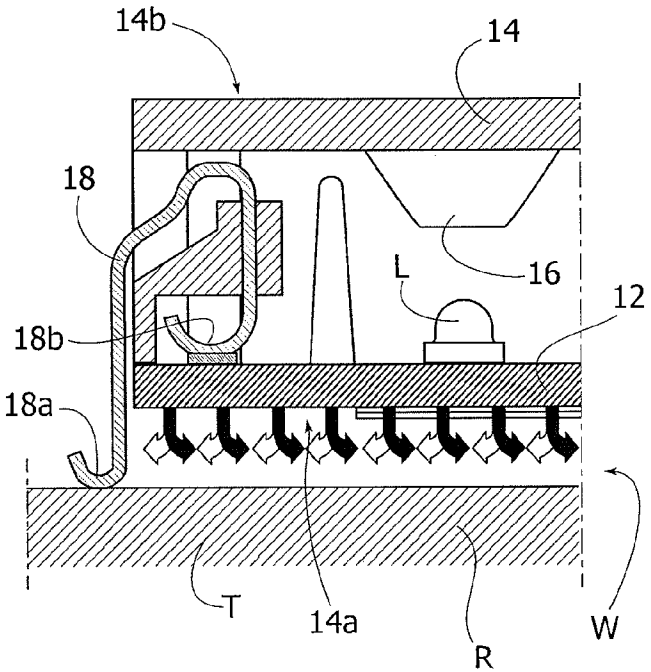
FIG. 3 is a cross-sectional view approximately along the line of FIG. 2C.

Still with reference to FIG. 3 it can be seen that, in various embodiments, the electrical contact or contacts 18 may be formed of a single piece of conductive material (for example metal) with a general U-shaped form where the following may be distinguished:

a loop portion which is fixed to the support structure 14;

a first and a second arm which extend from the aforementioned loop portion towards the terminal portions so as to perform, at a first end 18*a*, connection with a respective track T of the rail R and, at the second end 18*b*, connection with the board 12 (more precisely with conducting lines or paths/tracks provided on the board 12, not visible in the figures). In various embodiments, the first arm of the contact 18, i.e. that which extends towards the track T, may be longer than the second arm.

In various embodiments, the end of the first arm, denoted by 18*a*, and where necessary, also the end 18*b* of the second arm, may have a slider-like curved shape.

In the case of the end 18*a* which makes contact with a respective line T on the rail R, the slider-like shape allows the module 10 to slide along the rail R with the possibility, on the one hand, of maintaining the electrical contact (and therefore the activated condition of the module 10) and, on the other hand, avoiding undesirable wear of the contact and the rail.

In various embodiments, fixing of the contacts 18 on the structure 14 may be achieved, for example, by means of co-molding, by means of insertion inside fixing cavities or by means of locking with fixing elements.

Figure 4:
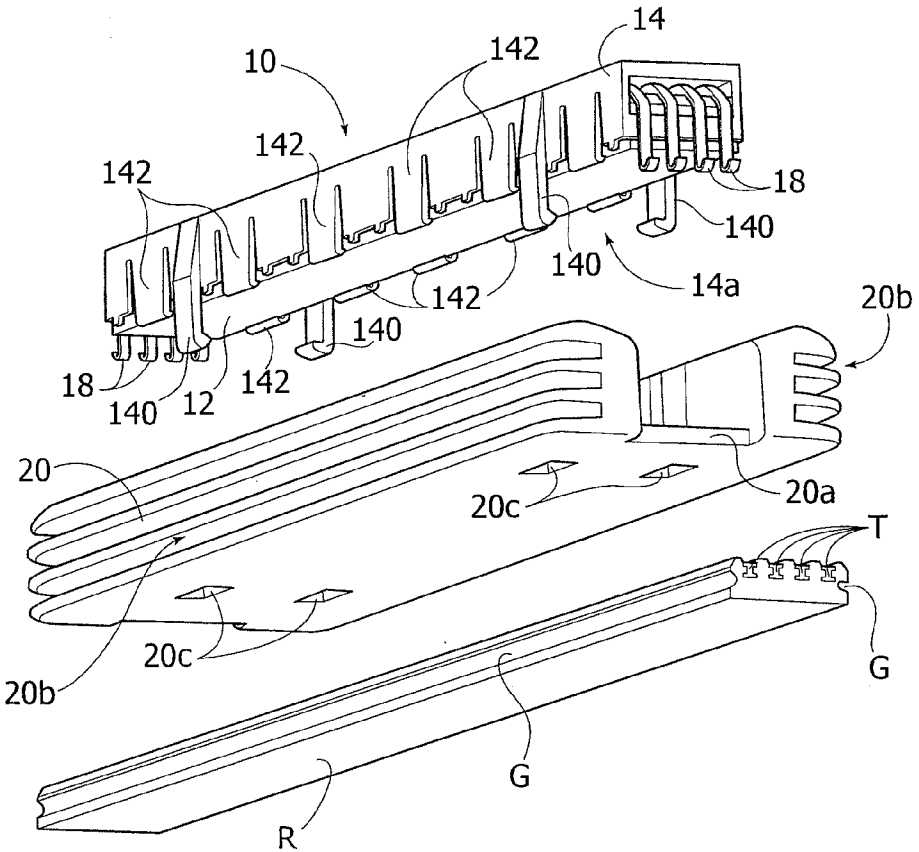
FIG. 4 is an exploded perspective view of an embodiment.
Figure 5:
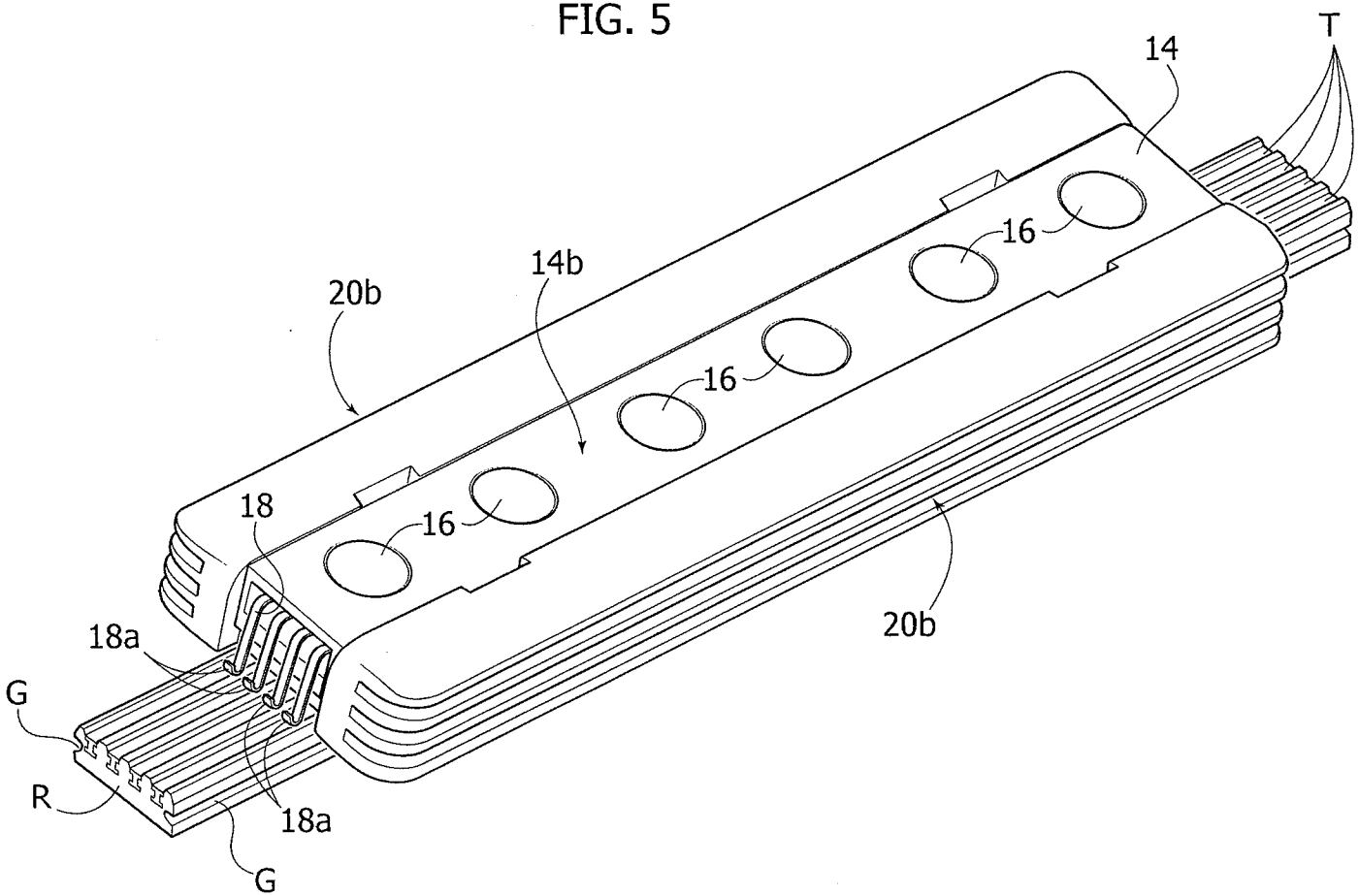
FIG. 5 shows the embodiment of FIG. 4 in the assembled condition.

FIGS. 4 and 5 relate to embodiments in which the presence of the ventilation space W may be used for connecting to the module 10 an auxiliary heat sink 20 (made for example of metallic or plastic material with heat dissipation properties) having a body portion 20*a* which can be seated inside the space W, as can be seen with reference to FIG. 4.

In various embodiments, the auxiliary heat sink 20 has a general U-shaped form with two lateral finned portions 20*b* which extend on either side of the body portion 20*a* so as to be arranged astride the structure 14 as is illustrated in FIG. 5.

In FIG. 4, the reference number 20*c* identifies openings provided in the auxiliary heat sink 20 (for example in the body part 20*a*) so as to allow the arms 140 which extend from the structure 14 to pass through and clasp the rail R (for example along the grooves G arranged on the sides of the rail).

Various embodiments therefore give rise to a so-called "light engine" (essentially formed by the module 10 carrying the sources L and the lenses 16) with the electrical contacts corresponding to the conducting lines of the board 12 which are, so to speak, "externalized" via the contacts 18, forming connection means which do not require the presence of connectors or wires.

The module 10 thus designed may be mounted stably on the rail R without having to use auxiliary fixing devices (screws, clamping devices, etc.), but by simply moving the arms 140 so that they clasp, for example by means of snap-engagement, the sides of the rail R, as schematically shown in the sequence of the parts a), b) and c) in FIG. 2. The same sequence, performed in the reverse order (namely c), b) and a)), allows the module 10 to be separated from the rail R.

The resilient properties of the arms 140 may also facilitate transverse self-centering of the module 14 with respect to the rail R.

Owing to the resilient nature of the contacts 18, it is also possible to compensate for any vertical play in the positioning of the board 12 with respect to the structure 14 and/or in the positioning of the structure 14 on the rail R.

In various embodiments, the space W between the board 12 and the rail R may allow, without making use of the auxiliary heat sink 20, efficient heat dissipation for installed power values of the sources L of up to 20 Watt per meter of length of the rail R.

In various embodiments, the methods envisaged for mounting the auxiliary heat sink 20 (see FIGS. 4 and 5) are such that the heat sink 20 may be brought into direct contact with the surface of the board 12 on which the light sources L are mounted, while ensuring the maximum freedom as regards the external dimensions of the heat sink 20, in particular as regards the finned portions 20*b*.

Obviously, without affecting the principle of the invention, the embodiments and the constructional details may vary, also significantly, with respect to that illustrated purely by way of a non-limiting example, without thereby departing from the scope of protection of the invention; this protective scope is defined by the accompanying claims.

The invention claimed is:

1. A lighting module for mounting on a rail having at least one electrical line extending therealong, the module comprising:

a circuit board for carrying at least one light radiation source; and a support structure with a first side facing the rail and carrying said circuit board and a second side situated on the opposite side to the rail and carrying at least one lens for said at least one light radiation source;

wherein said support structure carries at least one flexible electrical contact having a first end protruding from said first side of said support structure for making contact with said at least one electrical line and a second end which extends towards said circuit board so as to provide electrical contact for said at least one light radiation source.

2. The lighting module of claim 1, wherein said support structure comprises complementary arm portions protruding from said first side and capable of engaging with said rail.

3. The lighting module of claim 2, wherein said arm portions protrude from said first side beyond said circuit board so as to define a heat dissipation space.

4. The lighting module of claim 3, further comprising an auxiliary heat sink having a body portion inserted in said heat dissipation space and at least one finned portion extending from said body portion away from said support structure.

5. The lighting module of 4, wherein said auxiliary heat sink has a U-shaped cross section with two finned portions extending on opposite sides of said body portion astride said support structure.

6. The lighting module of claim 2, wherein said complementary arm portions are capable of engaging with said rail by means of snap-engagement.

7. The lighting module of claim 1, wherein said support structure has a channel shape with a central wall carrying said at least one lens on said second side and side walls extending from said central wall so as to carry said circuit board on said first side.

8. The lighting module of claim 1, wherein said at least one flexible electrical contact comprises a single piece with a loop portion anchored to said support structure and a first arm and a second arm extending from said loop portion with the distal portions of said first arm and said second arm forming said first end and said second end, respectively.

9. The lighting module of claim 8, wherein said first arm is longer than said second arm.

10. The lighting module of claim 1, wherein said first end has a slider-like shape.

11. The lighting module of claim 1, comprising said at least one light radiation source in the form of an LED light radiation source.

12. The lighting module of claim 1, wherein said first end and said second end have a slider-like shape.

* * * * *